US006153870A

United States Patent [19]

Kim et al.

[11] Patent Number: 6,153,870

[45] **Date of Patent: *Nov. 28, 2000**

[54] AC/DC TYPE MICROWAVE OVEN

[75] Inventors: Chul Kim, Anyang; Yong-woon Han, Kunpo; Seong-deog Jang, Suwon; Han-jun Sung, Seoul, all of Rep. of Korea

[73] Assignee: Samsung Electronics Co., Ltd., Suwon, Rep. of Korea

[ * ] Notice: This patent is subject to a terminal disclaimer.

[21] Appl. No.: 09/226,244

[22] Filed: Jan. 7, 1999

[30] Foreign Application Priority Data

| | | | |
|---|---|---|---|
| May 22, 1998 | [KR] | Rep. of Korea | 98-18588 |
| May 22, 1998 | [KR] | Rep. of Korea | 98-18590 |
| Jun. 8, 1998 | [KR] | Rep. of Korea | 98-21115 |
| Jun. 8, 1998 | [KR] | Rep. of Korea | 98-21116 |
| Aug. 29, 1998 | [KR] | Rep. of Korea | 98-35378 |
| Aug. 29, 1998 | [KR] | Rep. of Korea | 98-35380 |

[51] Int. Cl.[7] ..... H05B 6/66

[52] U.S. Cl. ..... 219/715; 219/702; 323/201; 363/15; 363/32

[58] Field of Search ..... 219/715, 716, 219/702; 363/15, 32; 323/201

[56] References Cited

U.S. PATENT DOCUMENTS

| | | | |
|---|---|---|---|
| 2,038,187 | 4/1936 | McNeil . | |
| 4,667,075 | 5/1987 | Sakurai | 219/715 |
| 4,900,885 | 2/1990 | Inumada | 219/716 |
| 4,904,837 | 2/1990 | Low et al. | 219/715 |
| 5,237,140 | 8/1993 | Akazawa et al. | 219/716 |
| 5,347,109 | 9/1994 | Nakabayshi et al. | 219/716 |

FOREIGN PATENT DOCUMENTS

| | | |
|---|---|---|
| 0 450 236 | 10/1991 | European Pat. Off. . |
| 0 505 082 | 9/1992 | European Pat. Off. . |
| 32-10728 | 12/1956 | Japan . |
| 54-36552 | 3/1979 | Japan . |
| 3-36938 | 2/1991 | Japan . |
| 3-205780 | 9/1991 | Japan . |
| 4-25194 | 2/1992 | Japan . |

*Primary Examiner*—Philip H. Leung
*Attorney, Agent, or Firm*—Burns, Doane, Swecker & Mathis, L.L.P.

[57] ABSTRACT

Disclosed is an AC/DC type microwave oven. The AC/DC type microwave oven comprises a rotatable inverter which inverts a DC power source to an AC power source by means of a rotational force, a high voltage transformer which receives a common power source or an AC power inverted by the rotatable inverter and outputs a higher voltage and a magnetron which is driven by the high voltage outputted from the high voltage transformer and radiates a microwave, and further comprises a control unit which controls the operation of the rotatable inverter so as to output a stable frequency. The rotatable inverter comprises a motor, a commutator driven by the motor and a plurality of brushes, which are respectively contacted with an outer surface of the commutator. Therefore, the manufacturing cost is lowered, the attrition rate of the current is lowered, the energy lost by heat is decreased, the size of the microwave oven can be smaller, and the output frequency from the rotatable inverter can be controlled to be kept constant and the microwaves are also more stably radiated.

7 Claims, 12 Drawing Sheets

AC/DC TYPE MICROWAVE OVEN

BACKGROUND OF THE INVENTION

1. Field of the Invention

The present invention relates to a microwave oven, and more particularly to a AC/DC type microwave oven which can be used with AC/DC power sources.

2. Description of the Prior Art

Generally, a microwave oven is an apparatus for cooking food by using a microwave. The microwave oven is provided with a high voltage transformer and a magnetron. The high voltage transformer serves to step up a common voltage of about 220V/110V to a high voltage of about 2,000V~4,000V. The magnetron is driven by the high voltage and radiates microwaves of a desired frequency. The microwaves vibrate molecules of moisture contained within the food. Therefore, the food is cooked by the frictional heat generated by the vibration of the moisture molecules. Here, the high voltage transformer receives an AC voltage via an input part thereof, and steps up or down the AC input voltage proportional to a turn ratio of a primary winding and a secondary winding thereof. The AC voltage which is stepped up or down is fed to an output part of the transformer. Typically, the conventional microwave oven described above is designed to be driven by an AC power source.

FIG. 1 is a circuit diagram showing the conventional microwave oven using the AC power source. In FIG. 1, a reference numeral 10 denotes a high voltage transformer, 11 is a primary coil, 12 is a first secondary coil, and 13 is a second secondary coil.

The primary coil 11 is wound on the input part of the high voltage transformer 10. The first and second secondary coils 12 and 13 are wound on the output part of the high voltage transformer 10. The primary coil 11 is connected with an AC power source AC. SW1 is a power switch. The power switch SW1 is located on a connecting wire which is disposed between the primary coil 11 and the AC power source AC, and connects or disconnects the primary coil 11 with the AC power source AC. A high voltage condenser HVC, a high voltage diode HVD and a magnetron MGT are connected to the output part of the transformer 10. The first secondary coil 12 pre-heats the magnetron MGT, and the second secondary coil 13 steps up the voltage provided by the AC power source to a voltage of about 2,000V. The second secondary coil 13 is connected with the magnetron via the high voltage condenser HVC and the high voltage diode HVD. The high voltage condenser HVC and the high voltage diode HVD are a voltage doubler to further step up the voltage raised by the second secondary coil 13 to a voltage of about 4,000V. The magnetron MGT is driven by the voltage of 4,000V and radiates a microwave of 2,450 MHz.

The operation of the conventional microwave oven constructed as above will be described as follows: If a user turns on the power switch SW1, the AC voltage is supplied to the high voltage transformer 10 via the power switch SW1. In the high voltage transformer 10, the AC input voltage is fed to the primary coil 11 of the input part and then induced to the first and second secondary coils 12 and 13 of the output part. The first secondary coil 12 pre-heats the magnetron MGT, and the second secondary coil 13 steps up the AC input voltage fed to the input part of the primary coil 11 to about 2,000V. The AC output voltage of about 2,000V, which is raised by the second secondary coil 13, is doubled by the high voltage condenser HVC and the high voltage diode HVD, and is then applied to the magnetron MGT. Therefore, the magnetron MGT is driven by the AC output voltage of about 4,000V and radiates a microwave of 2,450 MHz. The food within a cooking chamber (not shown) is cooked by the microwaves radiated by the magnetron MGT.

However, since the conventional microwave oven is designed to be driven by the common power source of AC 220V/110V, there is a problem that the conventional microwave oven can not be used in the open-air or in a ship, an aircraft or any other vehicles.

To overcome the above problem, there is proposed another conventional microwave oven that, when using the microwave oven in a place where an AC power source is not available, an inverter employing a separate semiconductor device may be connected with the microwave oven so as to invert a DC power source into an AC power source, or the inverter is disposed in the microwave oven itself.

FIG. 2 is a circuit diagram of a conventional microwave oven, and FIG. 3 is a circuit diagram of the inverter employing a semiconductor device. In FIG. 2, the construction of the part of AC power source is the same as FIG. 1, and in the part of the DC power source, there are disposed the inverter 20 employing a semiconductor device and a power switch SW2. The inverter employing a semiconductor device inverts the DC power source into the AC power source, and drives a high voltage transformer 10. A first primary coil 11 and a second primary coil 14 are wound on an input part of the high voltage transformer 10. The first primary coil 11 receives the AC power source, and the second primary coil 14 receives the AC power source inverted by the inverter 20. Further, a first secondary coil 12 and a second secondary coil 13 are wound on an output part of the high voltage transformer 10 along with a high voltage condenser HVC, a high voltage diode HVD and a magnetron MGT.

As shown in FIG. 3, the inverter 20 employing the semiconductor device comprises a trigger circuit 1, a plurality of thyristors th1 and th2 and a condenser C1. The plurality of thyristors th1 and th2 are switched on or off by a switching operation of the trigger circuit 1, and a current in the second primary coil 14 of the high voltage transformer 10 is thus outputted in turn, thereby generating the AC power source having a desired voltage in the high voltage transformer 10.

However, in this type of AC/DC microwave oven provided with the inverter employing the semiconductor device, there is a problem. That is, since it is necessary to provide a plurality of expensive semiconductor devices for the inverter in order to output a desired high voltage for the magnetron, the manufacturing cost is increased.

In the above conventional AC/DC microwave oven, there is another problem that the life span of the battery which supplies the DC power source is short, since the attrition rate of the current by the semiconductor device is very high.

In the above conventional AC/DC microwave oven, there is another problem that, since the semiconductor device generates excessive heat, energy loss by the heat is increased.

In the above conventional AC/DC microwave oven, there is a further problem that, since the size of the cooling fins is increased to cool the semiconductor device, the size of the microwave oven has also to be increased.

SUMMARY OF THE INVENTION

The present invention has been designed to overcome the above problems, and accordingly, it is an object of the present invention to provide an AC/DC type microwave oven of which the manufacturing cost is decreased.

Another object of the present invention is to provide an AC/DC type microwave oven in which the attrition rate of the current by the semiconductor device is lowered and the life span of the battery is much longer.

Another object of the present invention is to provide an AC/DC type microwave oven in which the energy loss by the heat is lowered.

A further object of the present invention is to provide an AC/DC type microwave oven of which the size is small, thereby facilitating the handling of the microwave oven.

Yet another object of the present invention is to provide an AC/DC type microwave oven which is capable of stably outputting the microwaves.

The above object is accomplished by the AC/DC type microwave oven according to the present invention comprising, a rotatable inverter which inverts a DC power source to an AC power source by means of a rotational force, a high voltage transformer which receives a common power source or an AC power inverted by the rotatable inverter and outputs a higher voltage and a magnetron which is driven by the high voltage outputted from the high voltage transformer and radiates a microwave. The rotatable inverter comprises a motor generating the rotational force, a commutator driven by the motor and a plurality of brushes which are, respectively, contacted with the outer surface of the commutator. The commutator comprises a cylindrical body made of an insulating material, and conductive parts which are divided into an even-number by non-conductive parts, respectively, having a desired width, whereby two brushes which are adjacent to each other are simultaneously contacted with one side of the conductive parts. Each of the non-conductive parts has a width which is wider than an end of the brush or which is the same as the end of the brush. The rotatable inverter further comprises a power switch which connects or disconnects the DC power source with the motor and brushes. One pair of the brushes which are opposite to each other are connected through the power switch to the DC power source, and the other pair of the brushes which are opposite each other are connected to the side of the high voltage transformer. The motor is connected in parallel with a pair of brushes which are connected through the power switch to the DC power source. The power switch is connected in parallel with a condenser. Between the respective brushes, which are adjacent to each other, respectively, is connected diodes for preventing a backward voltage. The high voltage transformer comprises a first primary coil to which the common power source is inputted, and a second primary coil to which the AC power inverted by the rotatable inverter is inputted. The second primary coil is made of a plate-type coil having a larger cross-sectional surface than that of the first primary coil.

Another object of the present invention is accomplished by the AC/DC microwave oven according to the present invention, comprising a rotatable inverter which inverts a DC power source to an AC power source by means of a rotational force, a high voltage transformer which receives a common power source or an AC power inverted by the rotatable inverter and outputs a higher voltage, a magnetron which is driven by the high voltage outputted from the high voltage transformer and radiates a microwave, an AC load driven by the common power source and a DC load driven by the DC power source which is supplied to the rotatable inverter. This microwave oven further comprises a first power switch which connects or disconnects the AC power source with the high voltage transformer, a first main switch which is switched on together with the driving of the transformer and drives the AC load, a second power switch which connects or disconnects the DC power source with the rotatable inverter and a second main switch which is switched on together with the driving of the rotatable inverter and drives the DC load.

Another object of the present invention is accomplished by the AC/DC microwave oven according to the present invention, comprising a rotatable inverter which inverts a DC power source to an AC power source by means of a rotational force, a high voltage transformer which receives a common power source or an AC power inverted by the rotatable inverter and outputs a higher voltage, a magnetron which is driven by the high voltage outputted from the high voltage transformer and radiates a microwave and an AC/DC load driven by the common power source or the DC power source which is supplied to the rotatable inverter. This microwave oven further comprises a first power switch which connects or disconnects the AC power source with the high voltage transformer, a second power switch which connects or disconnects the DC power source with the rotatable inverter and a main switch which is switched on together with the driving of the transformer or the driving of the rotatable inverter and drives the AC/DC load.

Yet another object of the present invention is accomplished by the AC/DC microwave oven according to the present invention, comprising a rotatable inverter which inverts a DC power source to an AC power source by means of a rotational force, a high voltage transformer which receives a common power source or an AC power inverted by the rotatable inverter and outputs a higher voltage, a magnetron which is driven by the high voltage outputted from the high voltage transformer and radiates a microwave and a control unit which controls the operation of the rotatable inverter so as to output a stable frequency. The control unit comprises a rotative speed detecting means which detects the rotative speed of the commutator, a micro-computer which compares the rotative speed of the commutator detected by the rotative speed detecting means with a reference rotative speed and outputs the corresponding signal for controlling the rotative speed, a rotative speed adjusting means which adjusts the rotative speed of the motor according to the signal from the micro-computer. The rotative speed detecting means has at least one switching transistor of which a base terminal is connected to one of the brushes, the switching transistor being switched on/off by the rotation of the commutator 130, thereby generating a pulse. The rotative speed adjusting means has at least one switching transistor which is switched on/off by the signal for controlling the rotative speed from the micro-computer, thereby adjusting the rotative speed of the motor.

Yet another object of the present invention is accomplished by the AC/DC microwave oven according to the present invention, comprising a rotatable inverter which inverts a DC power source to an AC power source by means of a rotational force, a high voltage transformer which receives a common power source or an AC power inverted by the rotatable inverter and outputs a higher voltage, a magnetron which is driven by the high voltage outputted from the high voltage transformer and radiates a microwave, an AC load driven by the common power source, a DC load driven by the DC power source which is supplied to the rotatable inverter and a control unit which controls the operation of the rotatable inverter so as to output a stable frequency.

Yet another object of the present invention is accomplished by the AC/DC microwave oven according to the present invention, comprising a rotatable inverter which inverts a DC power source to an AC power source by means of a rotational force, a high voltage transformer which receives a common power source or an AC power inverted by the rotatable inverter and outputs a higher voltage and a magnetron which is driven by the high voltage outputted from the high voltage transformer and radiates a microwave, an AC/DC load driven by the common power source or the DC power source which is supplied to the rotatable inverter and a control unit which controls the operation of the rotatable inverter so as to output a stable frequency.

Therefore, according to the present invention, the manufacturing cost is lowered, the attrition rate of the current is lowered, the energy loss by heat is decreased, the size of the microwave oven can be smaller, and the output frequency from the rotatable inverter can be controlled to be kept constant and the microwaves are also more stably radiated.

BRIEF DESCRIPTION OF THE DRAWINGS

The above objects and advantages will be more apparent by describing the present invention with reference to the accompanied reference drawings, in which.

DETAILED DESCRIPTION OF THE PREFERRED EMBODIMENT

Figure 1:
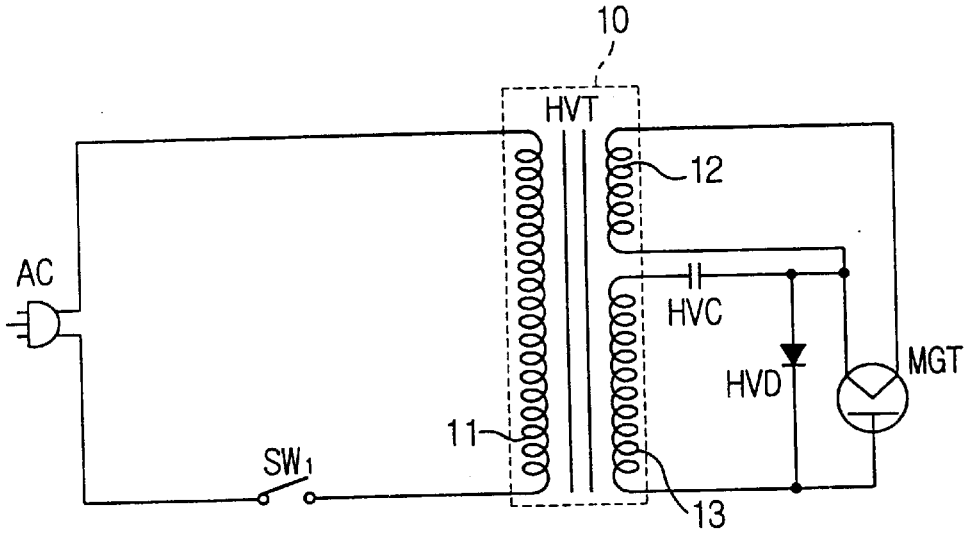
FIG. 1 (PRIOR ART)
FIG. 1 is a circuit diagram of a conventional AC type microwave oven.
Figure 2:
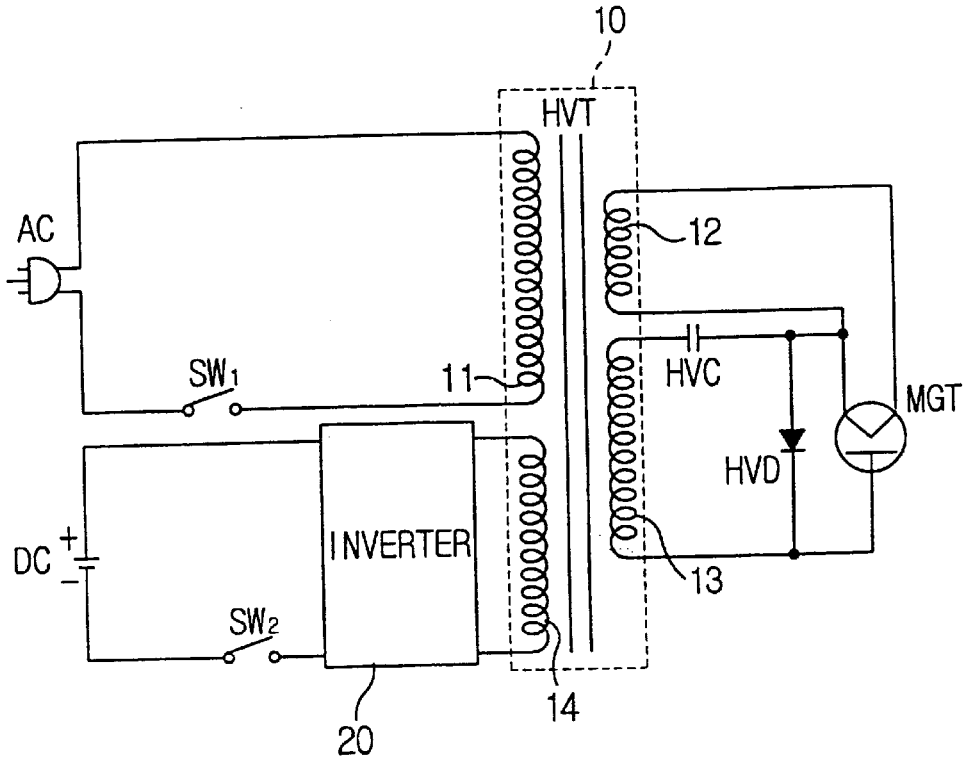
FIG. 2 (PRIOR ART)
FIG. 2 is a circuit diagram of another conventional AC/DC type microwave oven.
Figure 3:
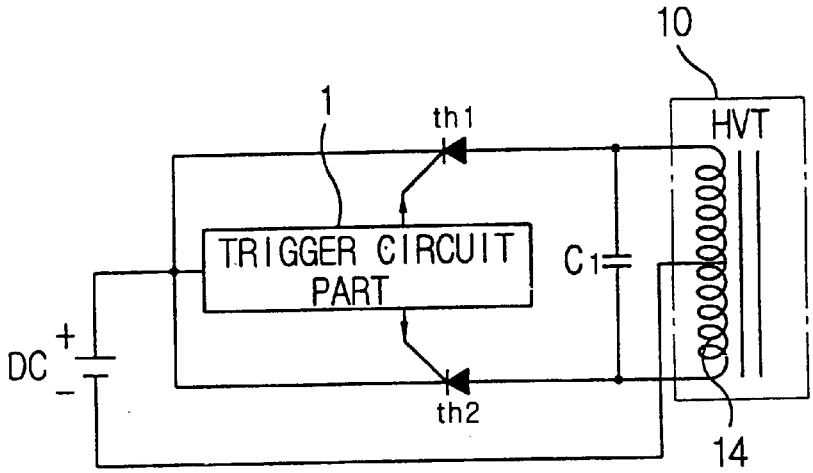
FIG. 3 (PRIOR ART)
FIG. 3 is a circuit diagram of the inverter used in the AC/DC type microwave oven of FIG. 2.
Figure 4:
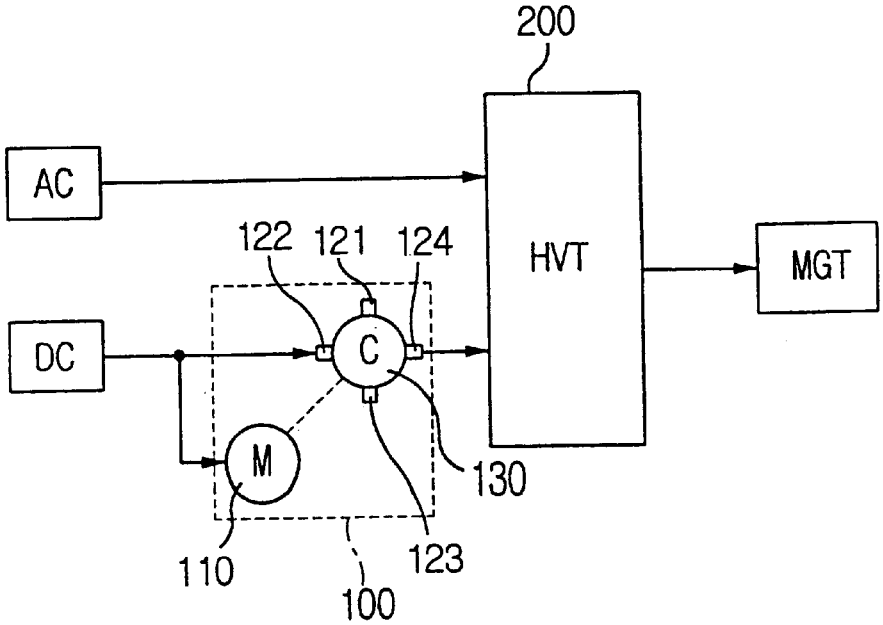
FIG. 4 is a block diagram of the AC/DC type microwave oven according to the first preferred embodiment of the present invention.
Figure 5:
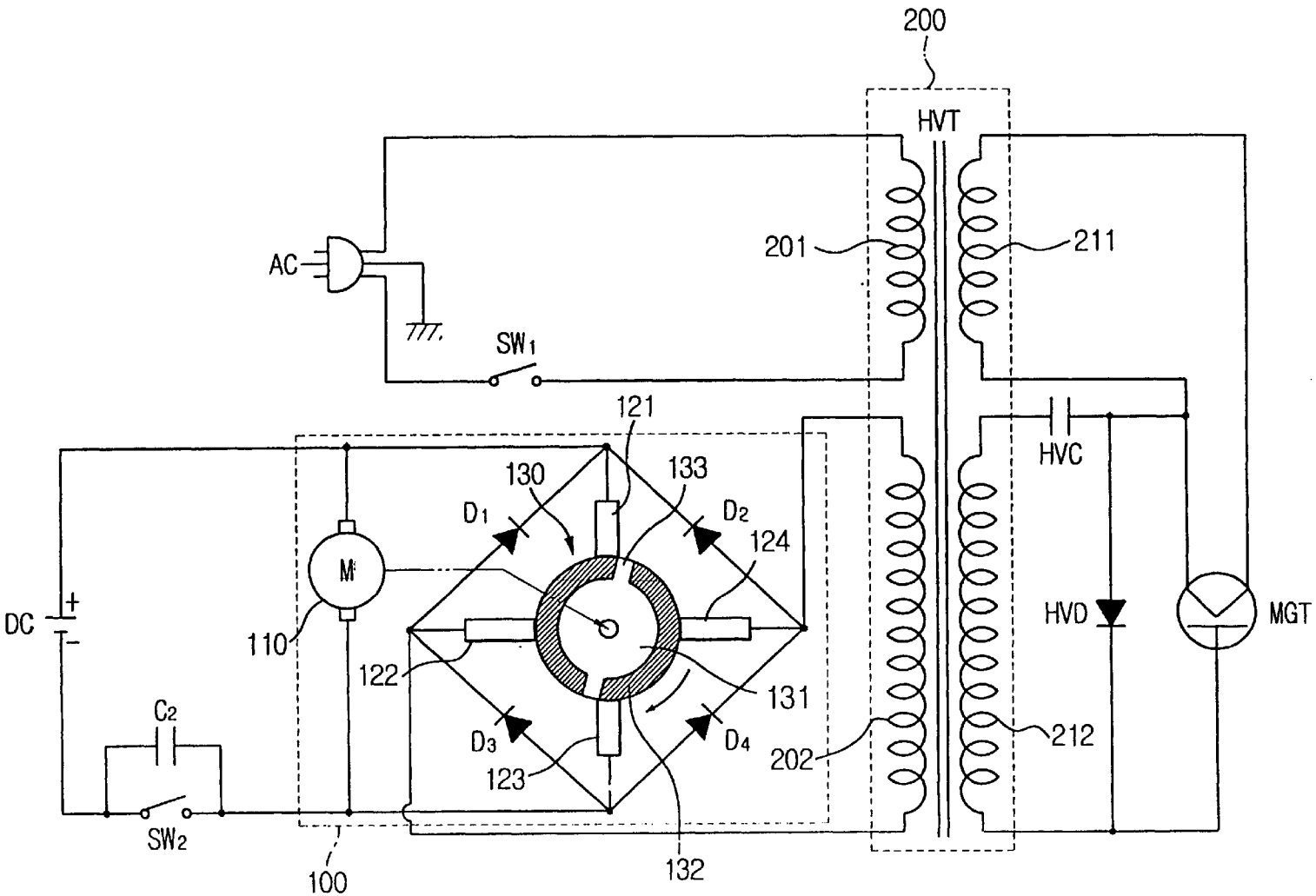
FIG. 5 is a circuit diagram of the AC/DC type microwave in FIG. 4.

FIG. 4 shows a circuit diagram of the AC/DC type microwave oven according to the first preferred embodiment of the present invention. FIG. 5 is a circuit diagram of FIG. 4.

In FIG. 4, a reference numeral 100 denotes a rotatable inverter, 110 is a motor, 121 to 124 are brushes, 130 is a commutator, 200 is a high voltage transformer, and MGT is a magnetron. The rotatable inverter 100 comprises the commutator 130, the brushes 121, 122, 123, 124, and the motor 110. Each of the brushes 121, 122, 123, 124 is contacted with the outer face of the commutator 200. The commutator 200 is rotated by the motor 110. The rotatable inverter 100 inverts a DC power source into an AC power source by the rotation of the commutator 130. The high voltage transformer 200 receives the AC power source inverted by the rotatable inverter 100 and outputs a desired high voltage. The magnetron MGT is driven by the high voltage outputted from the high voltage transformer 200 and radiates a microwave.

In FIG. 5, the high voltage transformer 200 comprises a first primary coil 201, a second primary coil 202, a first secondary coil 211 and a second secondary coil 212. Here, the first and second primary coils 201 and 202 are wound on an input part, and the first and second secondary coils 211 and 212 are wound on an output part. The common AC power source is inputted to the first primary coil 201, and the AC power inverted by the rotatable inverter 100 is inputted to the second primary coil 202. The common AC power source is fed through a power switch SW1 to the first primary coil 201 of the high voltage transformer 200. The power switch SW1 connects or disconnects the first primary coil 201 of the high voltage transformer 200 with the AC power source. A DC power source is supplied through a power switch SW2 to the rotatable inverter 100. The power switch SW2 connects or disconnects the rotatable inverter 100 with the DC power source. The rotatable inverter 100 comprises the commutator 130, the brushes 121, 122, 123, 124, and the motor 110. Each of the brushes 121, 122, 123, 124 is contacted with the outer face of the commutator 130. The commutator 130 is rotated by the motor 110. Here, one pair of brushes 121 and 123 which are opposite each other are connected to the DC power source, and the other pair of brushes 122 and 124 which are opposite each other are connected to the second primary coil 202 of the high voltage transformer 200. Each of diodes for preventing a backward voltage D1, D2, D3, D4 are respectively connected between the respective brushes 121, 122, 123, 124, which are adjacent to each other. The motor 110 is connected to the DC power source in parallel with the pair of brushes 121 and 123. Therefore, the DC power source is supplied to the brushes 121 and 123 and the motor 110 through the power switch SW2. A condenser C2 is connected with the power switch SW1 in parallel. The commutator 130 comprises a cylindrical body 131 and conductive parts 132 which are formed on the outer surface of the cylindrical body 131. The conductive parts 133 are respectively divided into an even-number by non-conductive parts 133 having a predetermined width, and respectively connected with the two brushes which are adjacent to each other. A high voltage condenser HVC, a high voltage diode HVD and the magnetron MGT are connected to the first secondary coil 211 and second secondary coil 212 of the high voltage transformer 200. The construction and operation thereof is the same as that of the prior art, so a detailed explanation thereof is thus omitted.

Figure 6:
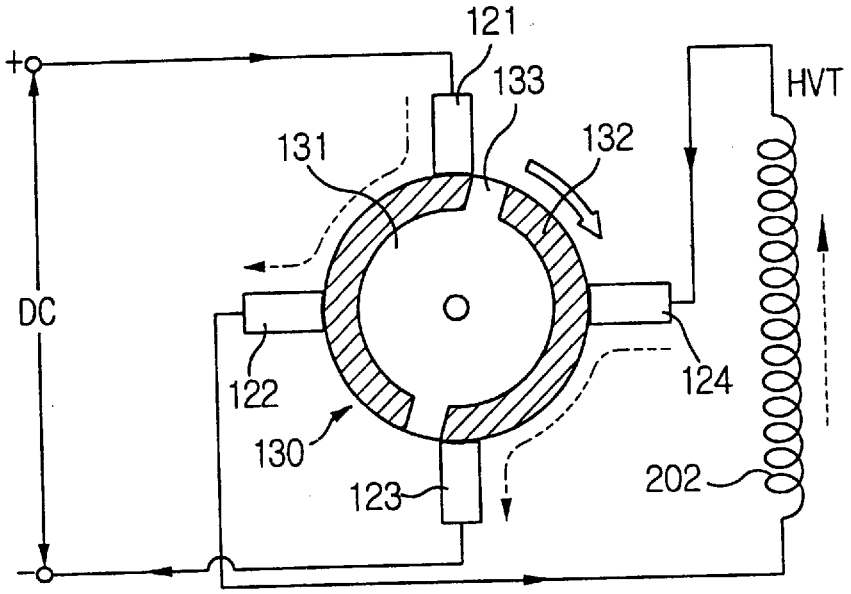
FIGS. 6 and 7 are views showing the operations of how the DC current is inverted into AC current according to the present invention.
Figure 7:
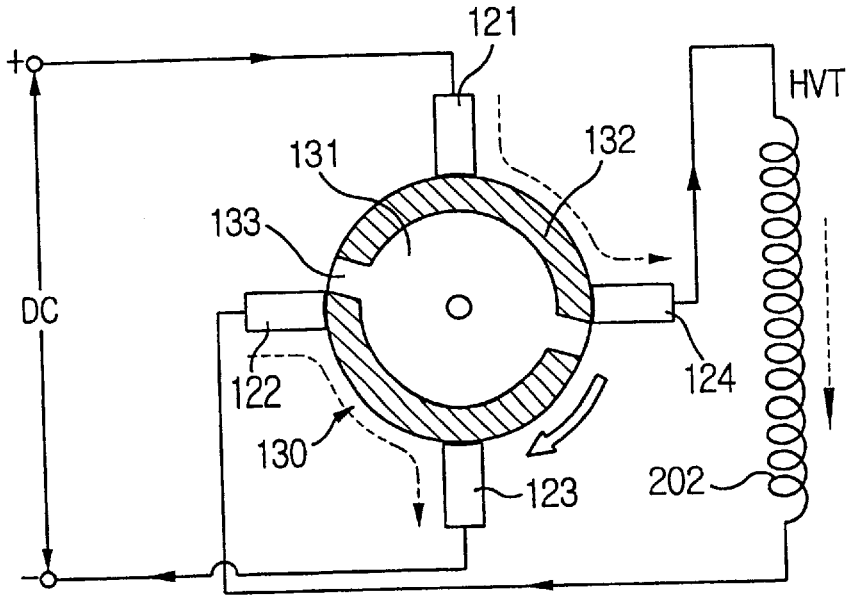

FIGS. 6 and 7 are views showing the operations of how the DC current is inverted into AC current according to the present invention.

As shown in FIG. 6, a current is inputted from a positive terminal of the DC power source to the upper brush 121, and flows through the conductive part 132 of the commutator 132 and the left brush 122 from a lower portion of the second primary coil 202 toward an upper portion of the second primary coil 202. Further, the current is inputted to the right brush 124 and circulated through the conductive part 132 and the lower brush 123 to a negative terminal of the DC power source.

In FIG. 7, the current from the positive terminal of the DC power source is inputted to the upper brush 121 and flows through the conductive part 132 of the commutator 130 and the right brush 124 from the upper portion of the second primary coil 202 toward the lower portion of the second primary coil 202, while the commutator 130 is rotated at a desired angle, for example at 90 degrees. Further, the current is inputted to the left brush 122 and circulated through the conductive part 132 and the lower brush 123 to a negative terminal of the DC power source.

Figure 8:
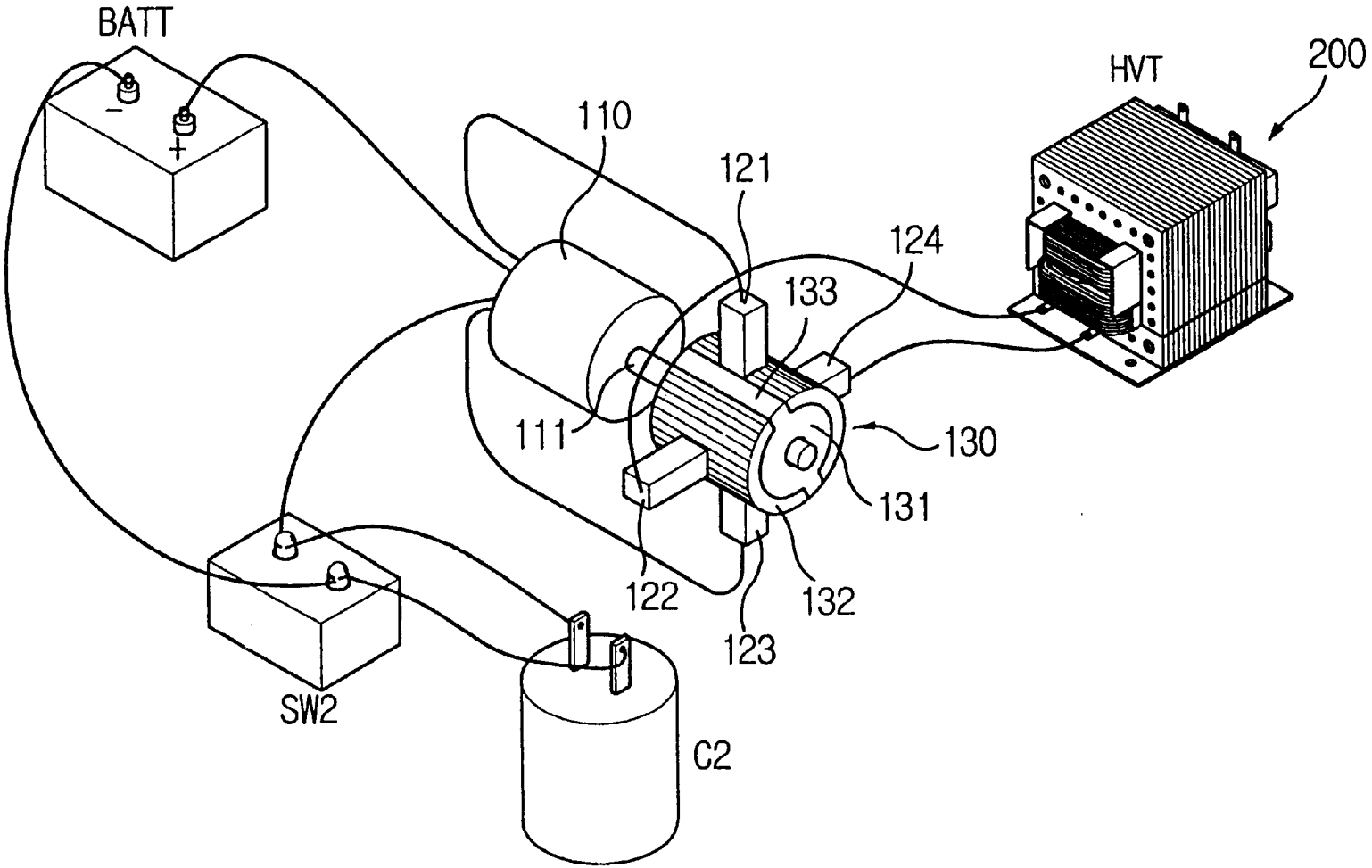
FIG. 8 is a schematic view showing the connected state of the component elements of the present invention.

FIG. 8 is a schematic view showing the connected state of the component elements of the present invention. In FIG. 8, a reference numeral 110 is a motor, 111 is a rotary shaft of the motor 110, and 121 to 124 are brushes, 130 is a commutator, 200 is a high voltage transformer, SW2 is a power switch, C2 is a condenser, and BATT is a battery. The commutator 130 is coupled to the rotary shaft 111 of the motor 110 to be rotated by the turning effect of the rotary shaft 111. The commutator 130 comprises a cylindrical body 131 and conductive parts 132 which are formed on the outer surface of the cylindrical body 131. Each of the conductive parts 132 is divided into an even-number by non-conductive parts 133 having a predetermined width. Here, it is preferable that the non-conductive part 132 has a width which is larger than that of each brush 121, 122, 123, 124, or which is the same as that. A battery of 12V or 24V is employed as a means for supplying a DC power source.

Figure 9:
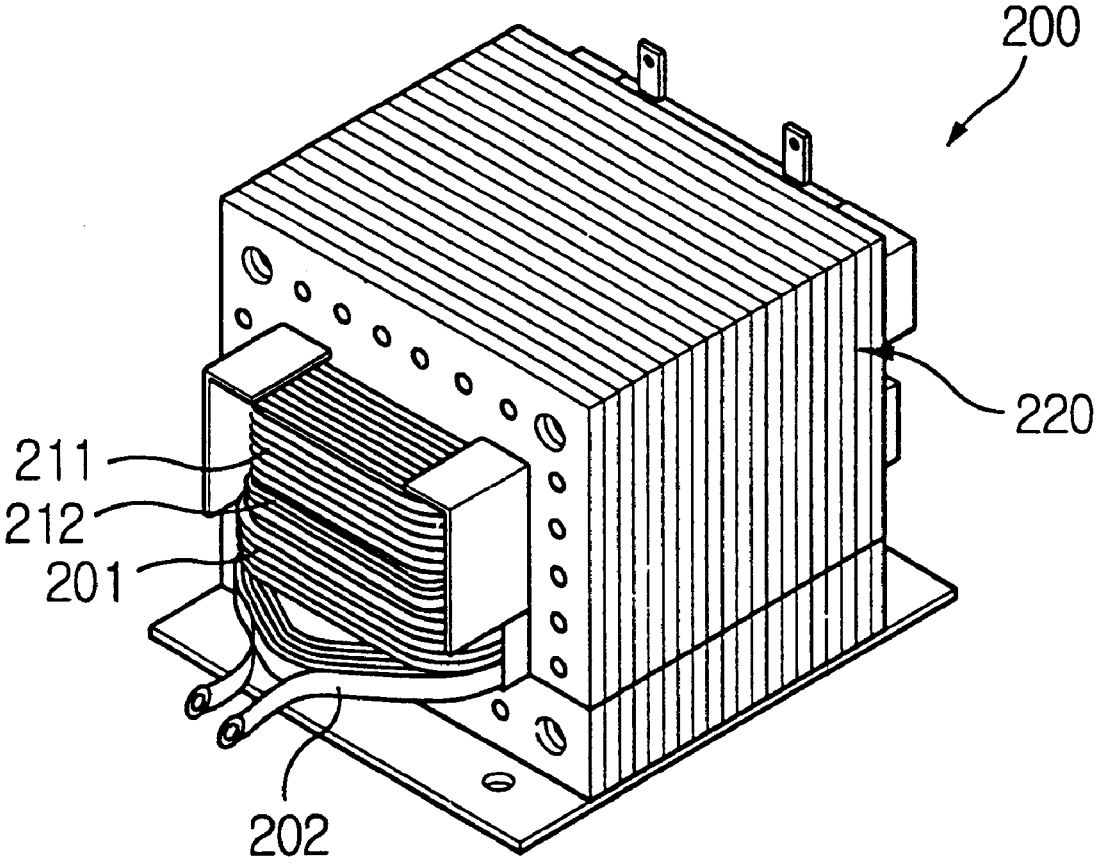
FIG. 9 is a perspective view of the high voltage transformer according to the present invention.

FIG. 9 is a perspective view of the high voltage transformer according to the present invention. In FIG. 9, a reference numeral 220 is a core, 201 is a first primary coil, 202 is a second primary coil, 211 is a first secondary coil, 212 is a second secondary coil. A common AC power source is inputted to the first primary coil 201, and inverted by a rotatable inverter 100. The inverted AC power is inputted to the second primary coil 202. And it is preferable that the second primary coil 202 is made of a plate-type coil having a larger cross-sectional surface than the first primary coil 201 so as to be operated in the extent of about 50 to 1,000 Hz.

The operation of the AC/DC type microwave oven as constructed above, according to the first embodiment of the present invention, will be explained in detail by the accompanying FIGS. 4 to 9.

In the operation by the DC power source, when the power switch SW2 is switched on by a user, the DC power source of 12V or 24V from the battery BATT is supplied through the power switch SW2 to the motor 110 and the upper brush 121. The condenser C2, which is connected in parallel with the switch SW2, charges or discharges a voltage so that the motor 110 can be smoothly rotated at an initial operation. As shown in FIG. 8, the commutator 130 is rotated by the rotary shaft 111 of the motor 110. Therefore, the conductive parts 132 are contacted with the respective brushes 121, 122, 123, 124 in turn, whereby the DC power source is inverted to an AC power source. That is, the current of the DC power source supplied from the positive terminal of the battery BATT is inputted through the upper brush 121 in FIG. 6 to the commutator 130. The current thus flows through the conductive part 132 toward the left brush 122, and is inputted from the lower portion of the second primary coil 202 of the high voltage transformer 200 to the upper portion thereof. And then, the current is circulated through the right brush 124, the conductive part 132 and the lower brush 123 to the negative terminal of the battery BATT. The DC power source supplied from the positive terminal of the battery BATT is inputted through the upper brush 121, the conductive part 132 and the right brush 124 from the upper portion of the second primary coil 202 toward the lower portion thereof, while the commutator 130 is rotated at a desired angle, for example, at 90 degrees as shown in FIG. 7. After that, the current is circulated through the left brush 122, the conductive part 132 and the lower brush 123 to a negative terminal of the battery. Therefore, in every one rotation (360 degrees) of the motor 110, the current direction in the second primary coil 202 of the high voltage transformer 200 is changed twice to up and down in turns, thereby generating the AC power of a desired frequency. The transformer 200 induces the AC power supplied to the second primary coil 202 into the first and second secondary coils 211 and 212. The first secondary coil 211 pre-heats the magnetron MGT, and the second secondary coil 212 steps up the inputted power to about 2,000V proportional to a turn ratio. The raised power is further stepped up through the high voltage condenser HVC and high voltage diode HVD to about 4,000V, and then supplied to the magnetron MGT. Therefore, the microwaves of 2,450 MHz are generated from the magnetron, and the food in the cooking chamber (not shown) is cooked by the microwaves.

In the operation by the common power source of 110V/220V, when the power switch SW1 is switched on by a user, the common power source from a power code is supplied through the power switch SW1 to the high voltage transformer 200. The transformer 200 induces the common power supplied to the first primary coil 201 into the first and second secondary coils 211 and 212. The first secondary coil 211 pre-heats the magnetron MGT, and the second secondary coil 212 steps up the inputted power to about 2,000V proportional to a turn ratio. The raised power is further stepped up through the high voltage condenser HVC and high voltage diode HVD to about 4,000V, and then supplied to the magnetron MGT. Therefore, the microwaves of 2,450 MHz are generated from the magnetron, and the food in the cooking chamber (not shown) is cooked by the microwaves.

According to the AC/DC microwave oven of the present invention, since the number of the constructive parts thereof may be reduced, the manufacturing cost is lowered. And since the semiconductor device is not used in the above microwave oven, the attrition rate of the current and the energy lost by heat are also lowered. The size of the microwave oven is also decreased by removing the cooling fins.

Figure 10:
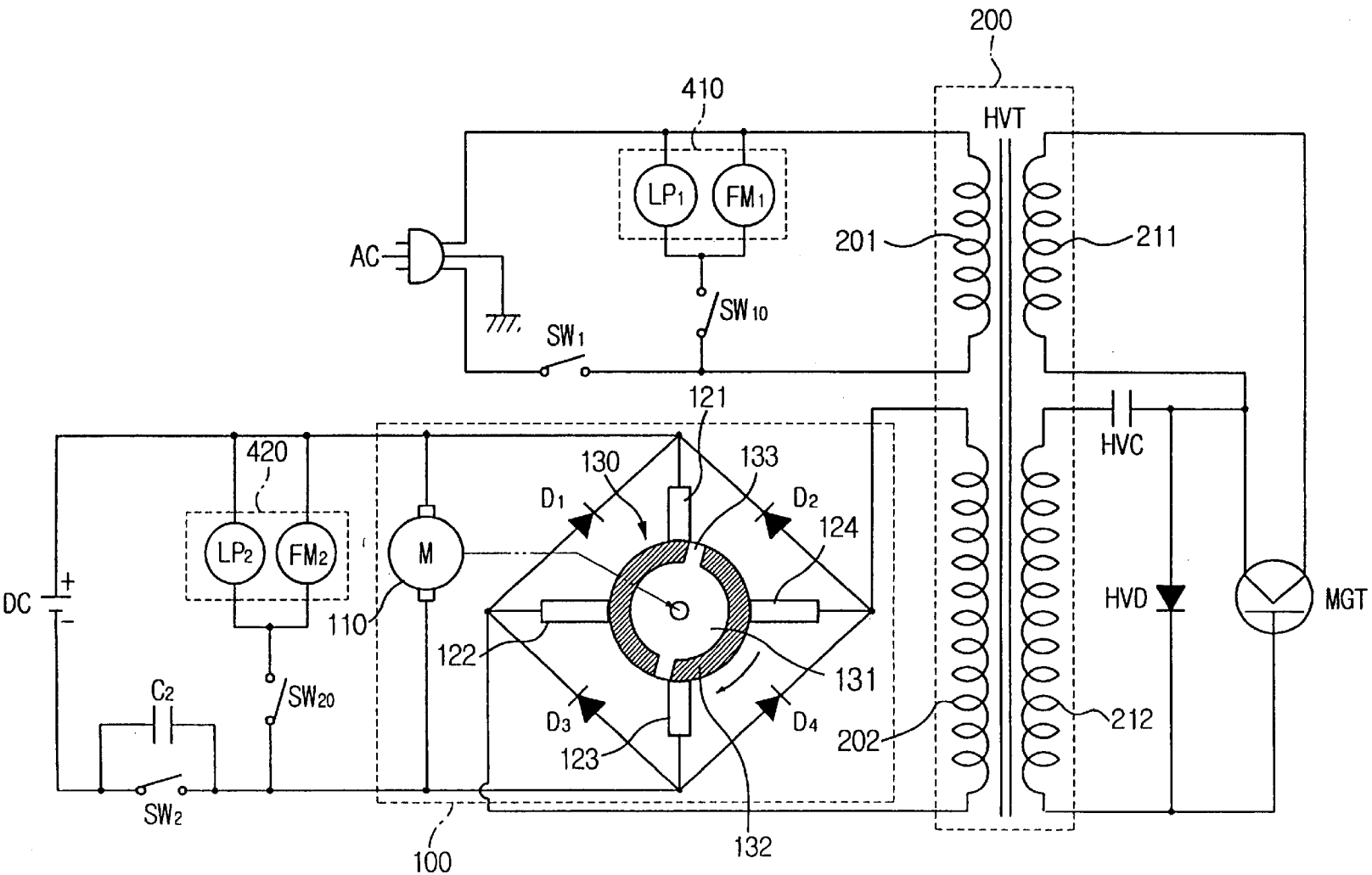
FIG. 10 is a circuit diagram according to the second preferred embodiment of the present invention.

FIG. 10 is a circuit diagram according to the second preferred embodiment of the present invention. In FIG. 10, the construction and operation of the motor 110, the rotatable inverter 100, the high voltage transformer 200, the magnetron MGT, the high voltage condenser HVC and the high voltage diode HVD are the same as the first embodiment of the present invention as shown in FIG. 5. The rotatable inverter 100 is provided with the brushes 121, 122, 123, 124 and the commutator 130. The transformer 200 has the first and second primary coils 201 and 202 and first and second secondary coils 211 and 212. However, the microwave oven according to the second preferred embodiment of the present invention further comprises an AC load 410 driven by the common power source, and a DC load 420 driven by the DC power source supplied to the rotatable inverter 100. The AC load 410 is provided with an AC lamp LP1 and a fan motor FM1, and the DC load 420 is provided with a DC lamp LP2 and a fan motor FM2. Further, the above microwave oven comprises a first power switch SW1, a first main switch SW10, a second power switch SW2 and a second main switch SW20. The first power switch SW1 connects or disconnects the common power source with the high voltage transformer 200. The first main switch SW10 is switched on together with the driving of the transformer 200 and drives the AC load 410. The second power switch SW2 connects or disconnects the DC power source with the rotatable inverter 100. The second main switch SW20 is switched on together with the driving of the rotatable inverter 100 and drives the DC load 420.

Accordingly, when the first power switch is switched on and the microwave oven is driven by the AC power, the first main switch SW10 is also switched on and operates the AC load 410 such as the AC lamp LP1 and the fan motor FM1. When the second power switch is switched on and the microwave oven is driven by the DC power, the second main switch SW20 is also switched on and operates the DC load 420 such as the DC lamp LP2 and the fan motor FM2. Therefore, the AC load 410 and DC load 420 are automatically selected corresponding to the inputted power. Here, the lamps LP1 and LP2 illuminate the inner portion of the cooking chamber (not shown), and the fan motor FM1 and FM2 cool the electric parts in the microwave oven so that the cooking efficiency is increased.

Figure 11:
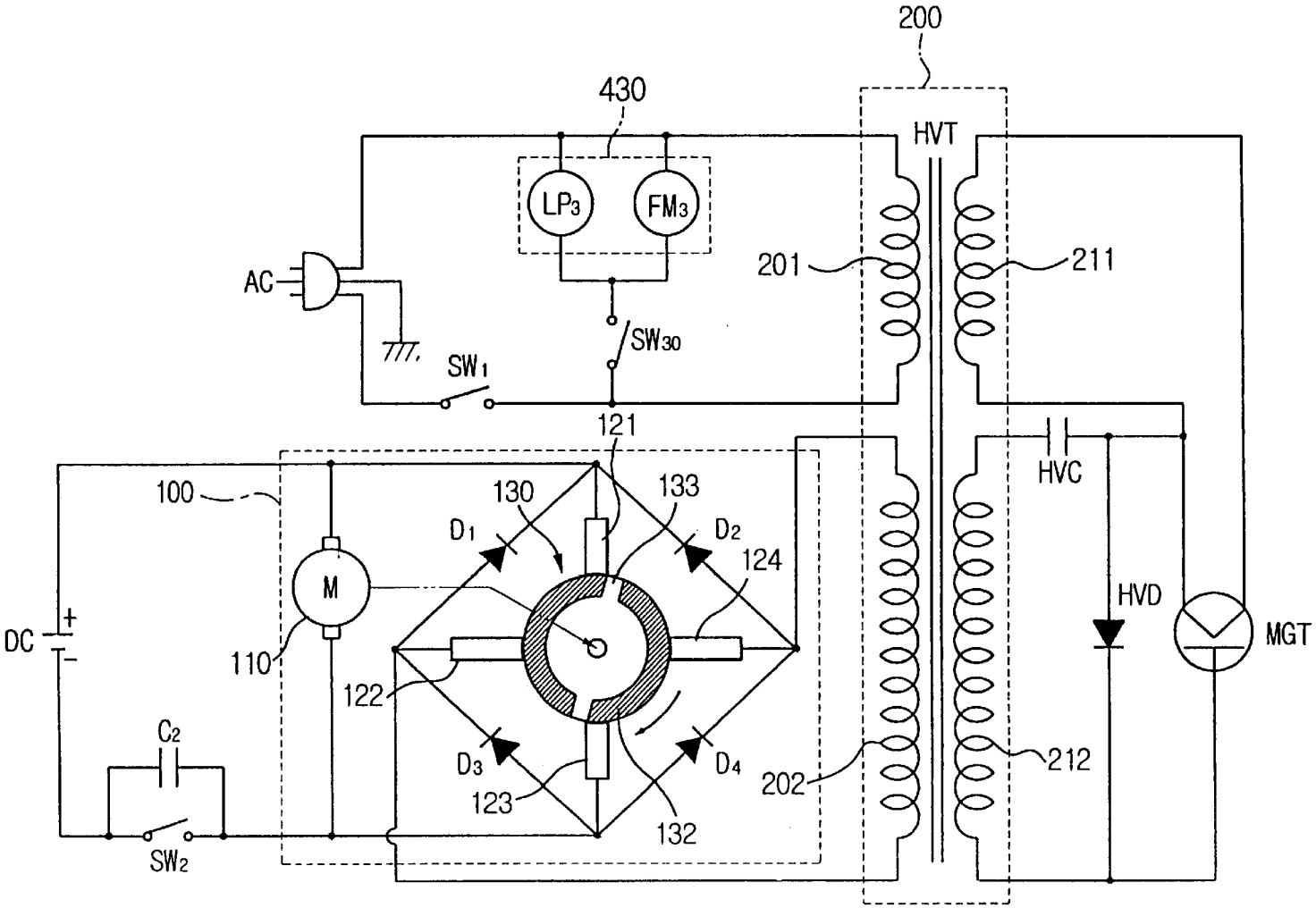
FIG. 11 is a circuit diagram according to the third preferred embodiment of the present invention.

FIG. 11 is a circuit diagram according to the third preferred embodiment of the present invention. In FIG. 11, the construction and operation of the motor 110, the rotatable inverter 100, the transformer 200, the magnetron MGT, the high voltage condenser HVC and the high voltage diode HVD are the same as the first embodiment of the present invention as shown in FIG. 5. The rotatable inverter 100 is provided with the brushes 121, 122, 123, 124 and the commutator 130. The transformer 200 has the first and second primary coils 201 and 202 and first and second secondary coils 211 and 212. However, the microwave oven according to the third preferred embodiment of the present invention further comprises an AC/DC load 430, which can be driven by the common power source or the AC power induced by the high voltage transformer 200 corresponding to the operation of the rotatable inverter 100. The AC/DC load 430 has an AC lamp LP3 and a fan motor FM3. Further, the above microwave oven comprises a first power switch SW1, a second power switch SW2 and a main switch SW30. The first power switch SW1 connects or disconnects the common power source with the high voltage transformer 200. The second power switch SW2 connects or disconnects the DC power source with the rotatable inverter 100. The main switch SW30 is switched on together with the driving of the high voltage transformer 200 or the rotatable inverter 100, and drives the AC/DC load 430. Here, the common power source is inputted to the first primary coil 201 of the transformer 200, and the AC power inverted by the rotatable inverter 100 is inputted to the second primary coil 202. These AC powers are induced to the first and second secondary coils 211 and 212 and also, the first primary coil 201. The AC/DC load 430 is connected to the common power source in the first primary coil 201.

Thus, when the first power switch is switched on and the microwave oven is driven by the AC power, the main switch SW30 is also switched on and operates the AC/DC load 430 such as the lamp LP3 and the fan motor FM3. Also, when the second power switch is switched on and the microwave oven is driven by the DC power, the main switch SW30 is switched on and operates the AC/DC load 430 such as the lamp LP3 and the fan motor FM3 with the AC power induced by the first primary coil 201 of the high voltage transformer 200. Here, the lamp LP3 illuminates an inner portion of the cooking chamber (not shown), and the fan motor FM3 cools the electric parts in the microwave oven so that the cooking efficiency is increased. Accordingly, since the lamp LP3 and the fan motor FM3 are driven by the common power source as well as the AC power inverted by the rotatable inverter 100, the number of the constructive parts of the microwave oven is decreased and the manufacturing cost thereof is also lowered.

Figure 12:
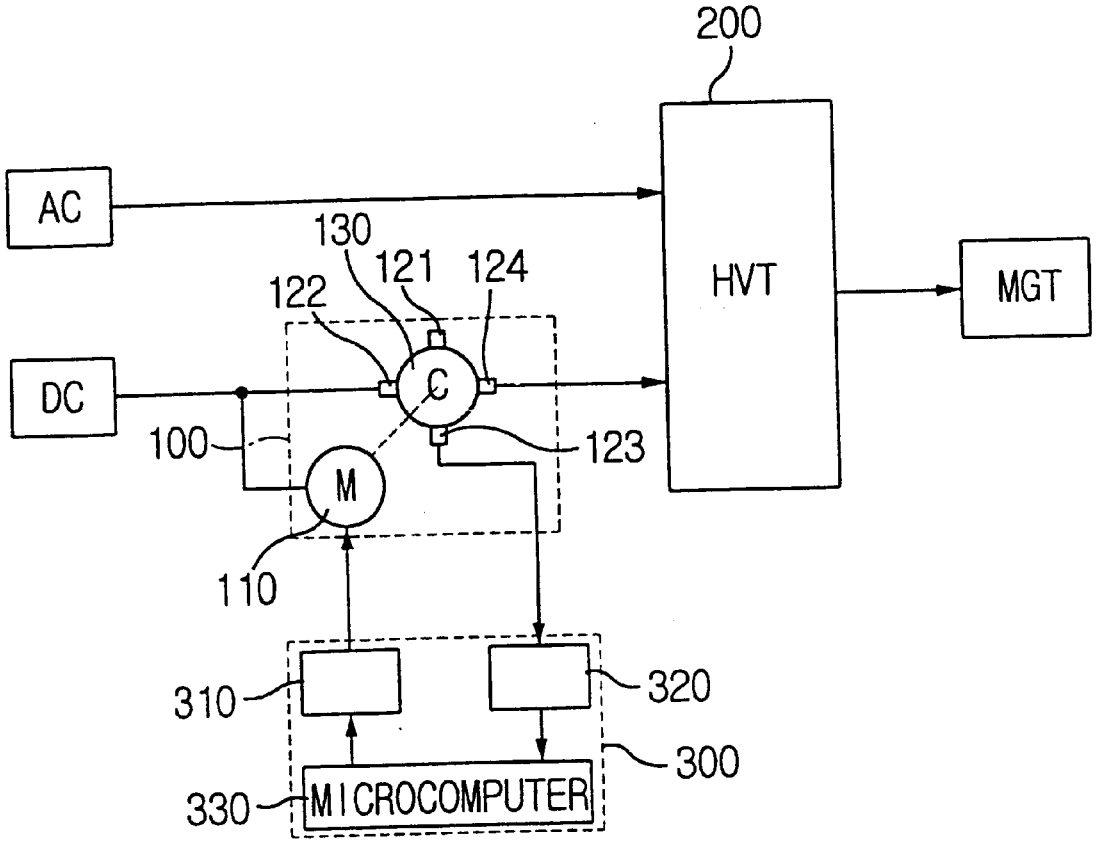
FIG. 12 is a block diagram according to the fourth preferred embodiment of the present invention.
Figure 13:
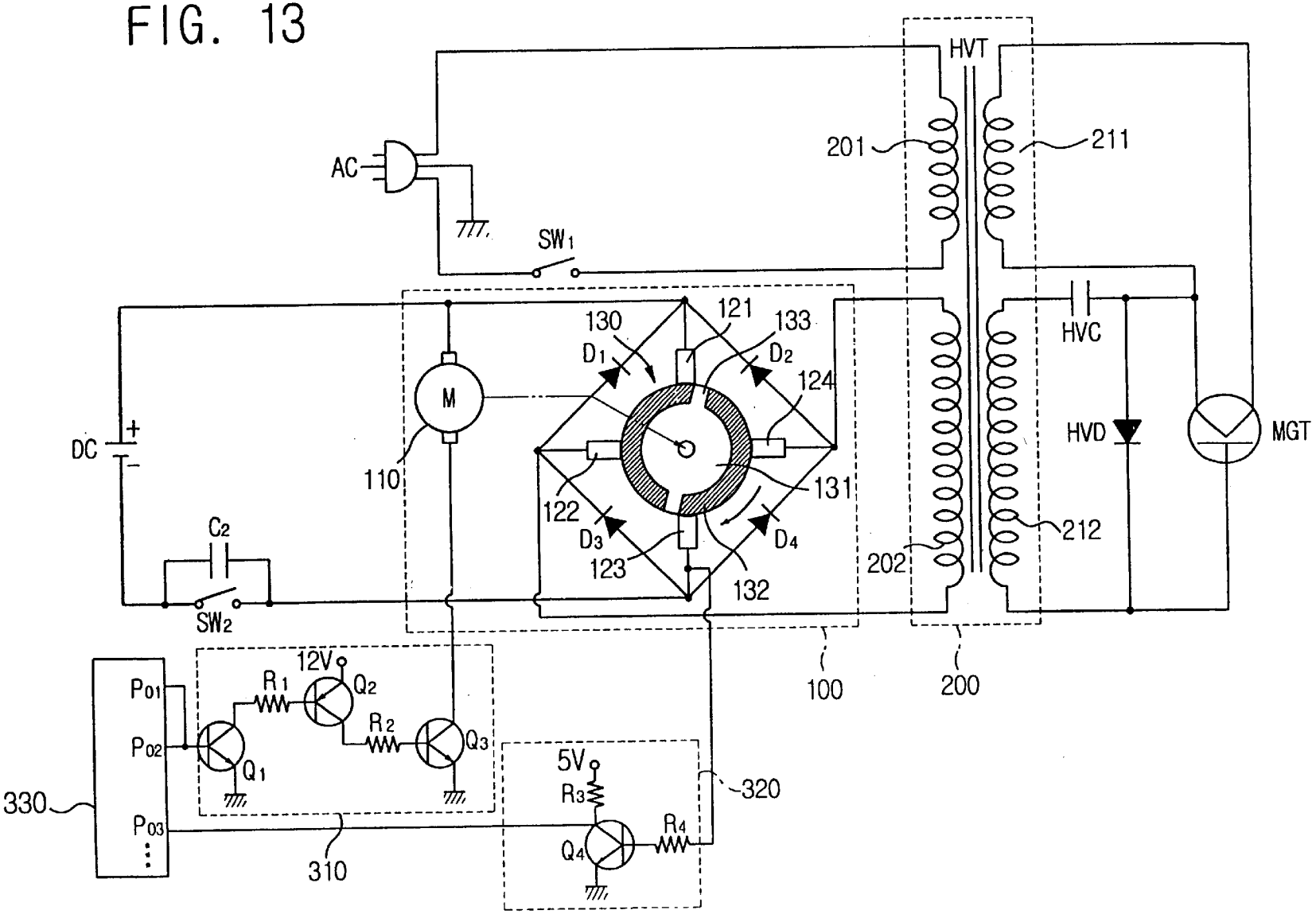
FIG. 13 is a circuit diagram of FIG. 12.

FIG. 12 is a block diagram according to the fourth preferred embodiment of the present invention, and FIG. 13 is a circuit diagram of FIG. 12. In FIG. 12, the construction and operation of the motor 110, the rotatable inverter 100, the transformer 200, the magnetron MGT, the high voltage condenser HVC and the high voltage diode HVD are the same as the first embodiment of the present invention as shown in FIG. 4. The rotatable inverter 100 is provided with the brushes 121, 122, 123, 124 and the commutator 130. However, the microwave oven according to the fourth preferred embodiment of the present invention further comprises a control unit 300 which controls the operation of the rotatable inverter 100 so as to output a stable frequency. The control unit 300 comprises a rotative speed detecting means 320, a micro-computer 330 and a rotative speed adjusting means 310. The rotative speed detecting means 320 detects a rotative speed of the commutator 130. The micro-computer 330 compares the rotative speed of the commutator 130 detected by the rotative speed detecting means 320 with a reference rotative speed and outputs a signal for controlling the rotative speed. The rotative speed adjusting means 310 adjusts the rotative speed of the motor 110 according to the signal from the micro-computer 330.

In FIG. 13, the first and second primary coils 201 and 202 of the high voltage transformer 200 are wound on the input part thereof, the first and second secondary coils 211 and 212 are wound on the output part thereof The common power source is inputted to the first primary coil 201, the AC power inverted by the rotatable inverter 100 is inputted to the second primary coil 202. The magnetron MGT, the high voltage condenser HVC and the high voltage diode HVD are connected to the first and second secondary coils 211 and 212 of the output part. The rotative speed detecting means 320 has a switching transistor Q4 of which a base terminal is connected to one of the brushes 123. The switching transistor Q4 is switched on/off by the rotation of the commutator 130, thereby generating a pulse. The rotative speed adjusting means 310 is provided with one or more switching transistors Q1, Q2, Q3 which are respectively switched or/off by the signal for controlling the rotative speed from the micro-computer 330.

Now, the operation of the main part of the microwave oven according to the fourth embodiment of the present invention is explained in detail, while the operation of the same part as the first embodiment is omitted.

When the power switch SW2 is switched on by a user, the DC power source of 12V or 24V from the battery BATT is supplied through the power switch SW2 to the motor 110 of the rotatable inverter 100 and the upper brush 121. The motor 11 rotates the commutator 130 coupled to the rotary shaft 111 thereof. Therefore, the conductive parts 132 on the outer surface of the commutator 130 are contacted with the respective brushes 121, 122, 123, 124 in turn, whereby the DC power source is inverted to an AC power source. This inverted AC power is supplied to the second primary coil 202 of the high voltage transformer 200. Here, the frequency of the AC power which flows in the second primary coil 202 of the high voltage transformer 200 is determined by the number of rotations of the motor 110.

In this situation, the micro-computer 330 outputs a reference pulse to an output port P02, and the rotative speed adjusting means 310 drives the motor 110 at a rotative speed corresponding to the reference pulse. The motor 110 rotates the commutator 130. At this time, the conductive part 132 and non-conductive part 133 of the commutator 130 are alternatively contacted with the respective brushes 121, 122, 123, 124 and invert the DC power to the AC power. And according to the rotation of the commutator 130, the transistor Q4 of the rotative speed detecting means 320 connected with a side of the brush 123 is switched on/off. That is, the base terminal of the transistor Q4 is connected with the brush 123 so that the base current can be supplied to the transistor Q4. When the conductive part 132 is contacted with the brush 123, the transistor Q4 is switched on. And when the non-conductive part 133 is contacted with the brush 123, the transistor Q4 is switched off. Therefore, the pulse of a desired frequency which is generated to correspond to the switching of the transistor Q4 is inputted to an input port P03 of the micro-computer 330. The micro-computer 330 calculates the value of the rotative speed of the commutator 130, using the pulse of the desired frequency which is inputted from the rotative speed detecting means 320, and then compares the calculated value with the reference rotative speed, and outputs the corresponding signal for controlling the rotative speed to the output port P01. If it is determined that the rotative speed of the commutator 130 is the same as the reference rotative speed, a signal for maintaining the current rotative speed of the motor 110 is outputted. If it is determined that the rotative speed of the commutator 130 is lower than the reference rotative speed, a signal for accelerating the rotative speed of the motor 110 is outputted. If it is determined that the rotative speed of the commutator 130 is higher than the reference rotative speed, a signal for decelerating the rotative speed is outputted. Here, the micro-computer 330 switches the transistors Q1, Q2, Q3 of the rotative speed controlling part 310 so that the rotative speed of the motor 110 is accelerated or decelerated. Therefore, the micro-computer 330 repeatedly performs the above processes, and the rotative speed of the motor 110 is kept constant. The AC power of a constant frequency is thus supplied to the high voltage transformer 200, whereby the magnetron MGT can stably radiate the microwaves.

Figure 14:
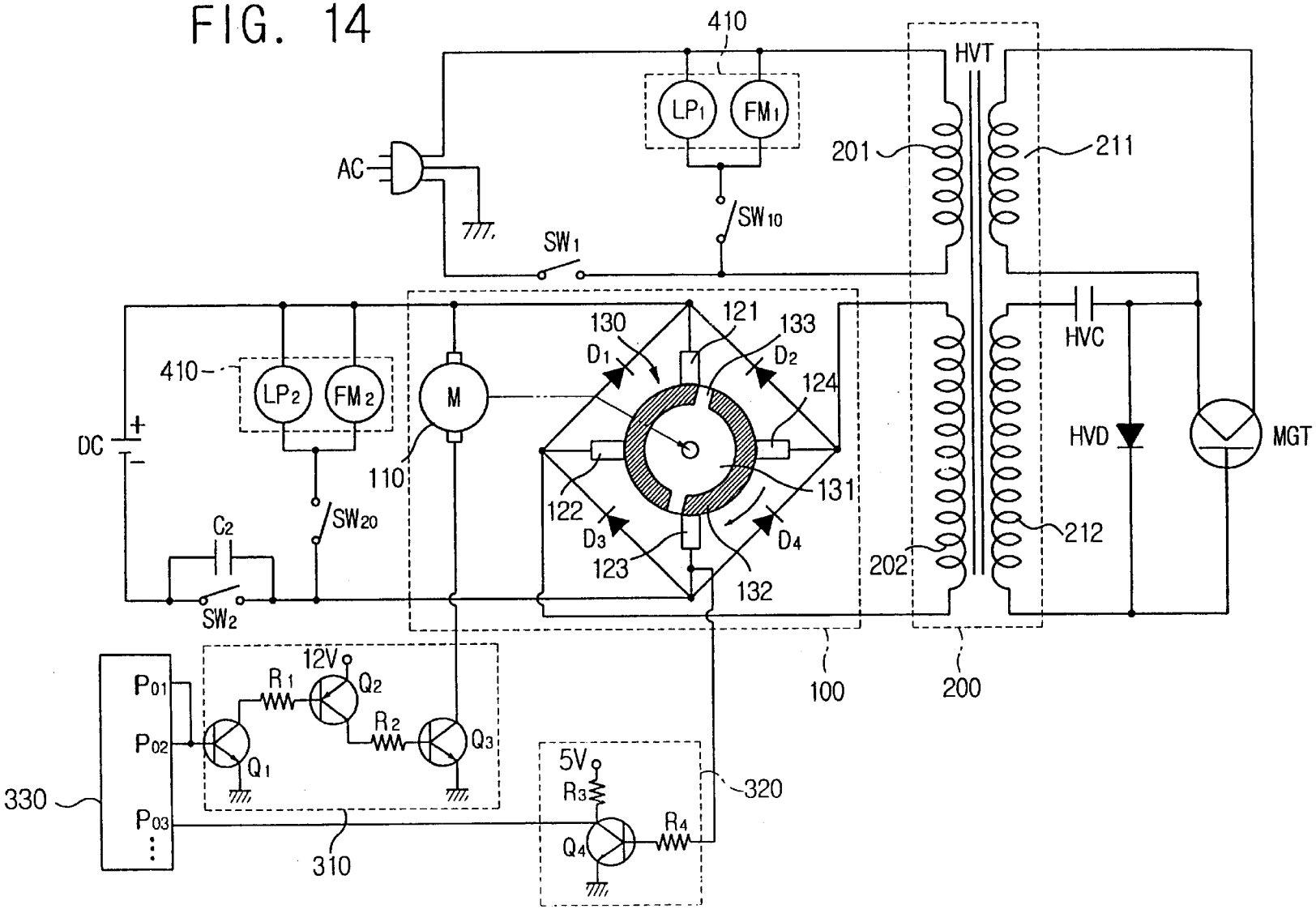
FIG. 14 is a circuit diagram according to the fifth preferred embodiment of the present invention.

FIG. 14 is a circuit diagram according to the fifth preferred embodiment of the present invention. In FIG. 14, the construction and operation of the motor 110, the rotatable inverter 100, the transformer 200, the magnetron MGT, the high voltage condenser HVC, the high voltage diode HVD and the control unit 300 are the same as the fourth embodiment of the present invention as shown in FIG. 13. The rotatable inverter 100 is provided with the brushes 121, 122, 123, 124 and the commutator 130. The transformer 200 contains the first and second primary coils 201 and 202 and first and second secondary coils 211 and 212. The control unit 300 comprises the rotative speed detecting means 320, the micro-computer 330 and the rotative speed adjusting means 310. However, the microwave oven according to the fifth preferred embodiment of the present invention further comprises an AC load 410 driven by a common power source, and a DC load 420 driven by the DC power source supplied to the rotatable inverter 100. The AC load 410 is provided with an AC lamp LP1 and a fan motor FM1, and the DC load 420 is provided with a DC lamp LP2 and a fan motor FM2. Further, the above microwave oven comprises a first power switch SW1, a first main switch SW10, a second power switch SW2 and a second main switch SW20. The first power switch SW1 connects or disconnects the common power source with the high voltage transformer 200. The first main switch SW10 is switched on together with the driving of the transformer 200 and drives the AC load 410. The second power switch SW2 connects or disconnects the DC power source with the rotatable inverter 100. The second main switch SW20 is switched on together with the driving of the rotatable inverter 100 and drives the DC load 420.

Accordingly, when the first power switch is switched on and the microwave oven is driven by the AC power, the first main switch SW10 is also switched on and operates the AC load 410 such as the AC lamp LP1 and the fan motor FM1. When the second power switch is switched on and the microwave oven is driven by the DC power, the second main switch SW20 is also switched on and operates the DC load 420 such as the DC lamp LP2 and the fan motor FM2. Therefore, the AC load 410 and DC load 420 are automatically selected corresponding to the inputted power. Here, the lamps LP1 and LP2 illuminate an inner portion of the cooking chamber (not shown), and the fan motor FM1 and FM2 cool the electric parts in the microwave oven so that the cooking efficiency is increased.

Figure 15:
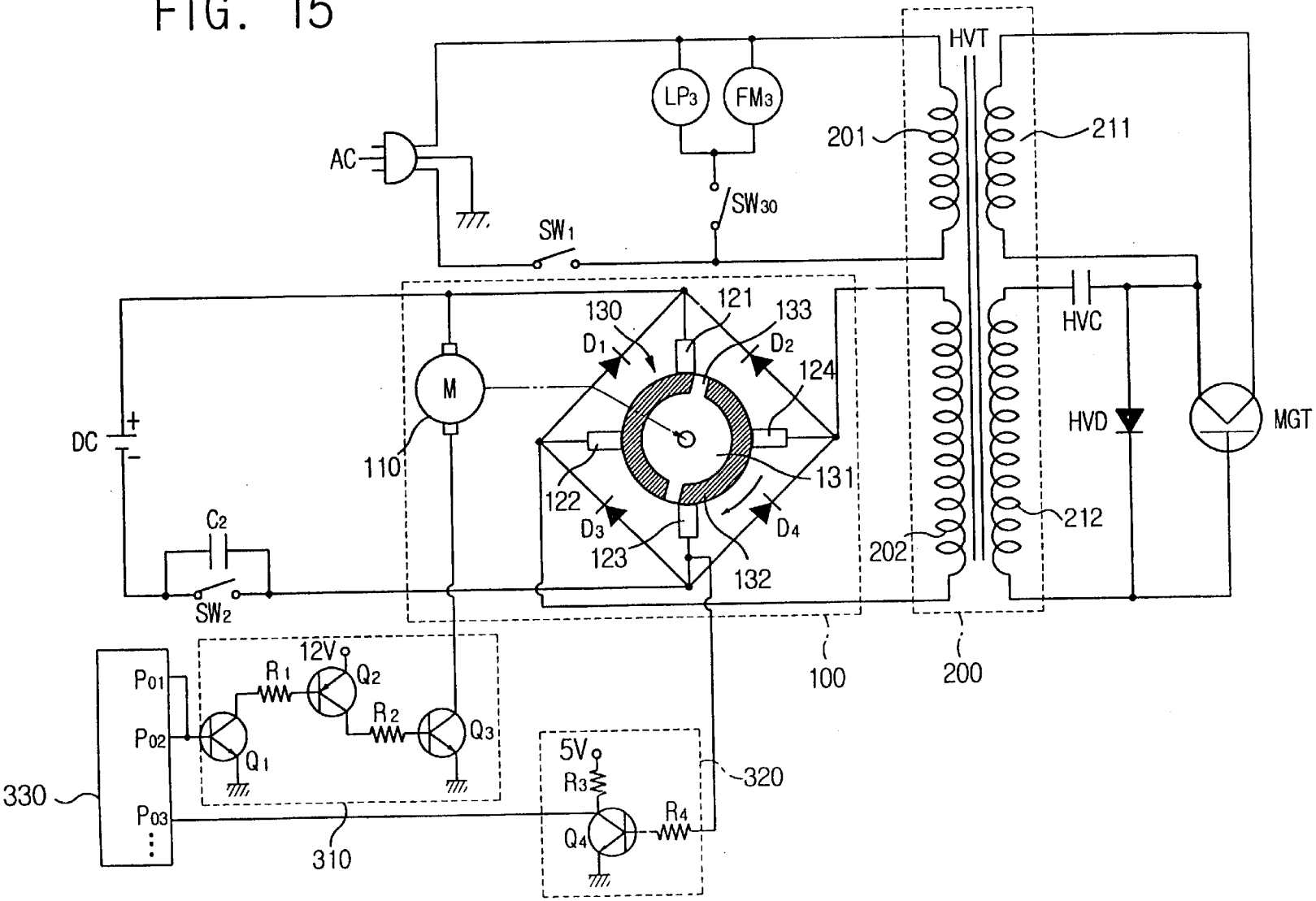
FIG. 15 is a circuit diagram according to the sixth preferred embodiment of the present invention.

FIG. 15 is a circuit diagram according to the sixth preferred embodiment of the present invention. In FIG. 15, the construction and operation of the motor 110, the rotatable inverter 100, the transformer 200, the magnetron MGT, the high voltage condenser HVC, the high voltage diode HVD and the control unit 300 are the same as the fourth embodiment of the present invention as shown in FIG. 13. The rotatable inverter 100 is provided with the brushes 121, 122, 123, 124 and the commutator 130. The transformer 200 has the first and second primary coils 201 and 202 and first and second secondary coils 211 and 212. The control unit 300 comprises the rotative speed detecting means 320, the micro-computer 330 and the rotative speed adjusting means 310. However, the microwave oven according to the sixth preferred embodiment of the present invention further comprises an AC/DC load 430 which can be driven by a common power source or the AC power induced by the high voltage transformer 200 corresponding to the operation of the rotatable inverter 100. The AC/DC load 430 has an AC lamp LP3 and a fan motor FM3. Further, the above microwave oven comprises a first power switch SW1, a second power switch SW2 and a main switch SW30. The first power switch SW1 connects or disconnects the common power source with the high voltage transformer 200. The second power switch SW2 connects or disconnects the DC power source with the rotatable inverter 100. The main switch SW30 is switched on together with the driving of the high voltage transformer 200 or the rotatable inverter 100, and drives the AC/DC load 430. Here, the common power source is inputted to the first primary coil 201 of the transformer 200, and the AC power inverted by the rotatable inverter 100 is inputted to the second primary coil 202. These AC powers are induced to the first and second secondary coils 211 and 212 and also, the first primary coil 201. The AC/DC load 430 is connected to the common power source in the first primary coil 201.

Thus, when the first power switch is switched on and the microwave oven is driven by the AC power, the main switch SW30 is also switched on and operates the AC/DC load 430 such as the lamp LP3 and the fan motor FM3. Also, when the second power switch SW2 is switched on and the microwave oven is driven by the DC power, the main switch SW30 is switched on and operates the AC/DC load 430 such as the lamp LP3 and the fan motor FM3 with the AC power induced by the first primary coil 201 of the high voltage transformer 200. Here, the lamps LP3 illuminates an inner portion of the cooking chamber (not shown), and the fan motor FM3 cools the electric parts in the microwave oven so that the cooking efficiency is increased. Accordingly, since the lamp LP3 and the fan motor FM3 are driven by the common power source as well as the AC power inverted the rotatable inverter 100, the number of the constructive parts of the microwave oven decreases and the manufacturing cost is considerably lowered.

According to the AC/DC microwave oven of the present invention, since the number of constructive parts thereof may be reduced, the manufacturing cost is lowered.

And, the life span of the battery which supplies the DC power source can be much longer, since the semiconductor device described in the prior art is not employed and the attrition rate of the current is very low.

Further, the energy loss by heat is decreased, since the semiconductor device described in the prior art is not employed.

Further, since the cooling fins employed in the prior art can be removed, the size of the microwave oven can be smaller.

Further, according to the present invention, since the output frequency from the rotatable inverter can be controlled to be kept constant, the microwaves are also stably radiated.

While the present invention has been particularly shown and described with reference to the preferred embodiment thereof, it will be understood by those skilled in the art that various changes in form and details may be affected therein without departing from the spirit and scope of the invention as defined by the appended claims.

What is claimed is:

1. An AC/DC type microwave oven comprising:

a rotatable inverter which inverts a DC power source to an AC power source by means of a rotational force;

a high voltage transformer which receives a common power source or an AC power inverted by the rotatable inverter and outputs a higher voltage; and a magnetron which is driven by the high voltage outputted from the high voltage transformer and radiates a microwave, wherein the rotatable inverter comprises a motor generating the rotational force, a commutator driven by the motor and a plurality of brushes which are respectively contacted with an outer surface of the commutator, and the commutator comprises a cylindrical body made of an insulating material, and conductive parts which are divided into an even-number by non-conductive parts, respectively, having a desired width, whereby two brushes which are adjacent to each other, are simultaneously contacted with one side of the conductive parts.

2. An AC/DC microwave oven as claimed in claim 1, wherein each of the non-conductive parts has a width which is wider than an end of the brush or which is the same as the end of the brush.

3. An AC/DC type microwave oven comprising:

a rotatable inverter which inverts a DC power source to an AC power source by means of a rotational force;

a high voltage transformer which receives a common power source or an AC power inverted by the rotatable inverter and outputs a higher voltage; and a magnetron which is driven by the high voltage outputted from the high voltage transformer and radiates a microwave;

wherein the rotatable inverter comprises a motor generating the rotational force, a commutator driven by the motor, a plurality of brushes which are respectively contacted with an outer surface of the commutator, and a power switch which connects or disconnects the DC power source with the motor and brushes.

4. An AC/DC microwave oven as claimed in claim 3, wherein one pair of the brushes which are opposite each other are connected through the power switch to the DC power source, and another pair of the brushes which are opposite each other are connected to the side of the high voltage transformer.

5. An AC/DC microwave oven as claimed in claim 3, wherein the motor is connected in parallel with the pair of brushes which are connected through the power switch to the DC power source.

6. An AC/DC microwave oven as claimed in claim 3, wherein the power switch is connected in parallel with a condenser.

7. An AC/DC type microwave oven comprising:

a rotatable inverter which inverts a DC power source to an AC power source by means of a rotational force;

a high voltage transformer which receives a common power source or an AC power inverted by the rotatable inverter and outputs a higher voltage; and a magnetron which is driven by the high voltage outputted from the high voltage transformer and radiates a microwave;

wherein the rotatable inverter comprises a motor generating the rotational force, a commutator driven by the motor, and a plurality of brushes which are respectively contacted with an outer surface of the commutator, and between the respective brushes, which are adjacent to each other, is respectively connected diodes for preventing a backward voltage.

* * * * *